US006437694B1

(12) United States Patent
Lee

(10) Patent No.: US 6,437,694 B1
(45) Date of Patent: Aug. 20, 2002

(54) AIR CONTROLLED SENSOR

(76) Inventor: Jung K. Lee, 2209 Old Bosley Rd., Timonium, MD (US) 21093

( * ) Notice: Subject to any disclaimer, the term of this patent is extended or adjusted under 35 U.S.C. 154(b) by 0 days.

(21) Appl. No.: 09/561,916

(22) Filed: May 1, 2000

Related U.S. Application Data

(60) Provisional application No. 60/132,001, filed on Apr. 30, 1999.

(51) Int. Cl.[7] ..... G08B 13/20

(52) U.S. Cl. ..... 340/544; 340/605; 340/606; 340/608; 340/611

(58) Field of Search ..... 340/544, 540, 340/607, 606, 608, 541, 565; 417/1, 4; 73/861

(56) References Cited

U.S. PATENT DOCUMENTS 3,949,355 A * 4/1976 Newmeyer ..... 340/38
4,558,326 A * 12/1985 Kimura et al. ..... 346/1.1
4,853,690 A * 8/1989 Mayer et al. ..... 340/544
4,862,163 A * 8/1989 Sobut ..... 340/940
4,882,575 A * 11/1989 Kawahara ..... 340/608
5,021,766 A * 6/1991 Genahr et al. ..... 340/544
5,548,275 A * 8/1996 Shambayate et al. ..... 340/573

* cited by examiner

*Primary Examiner*—Jeffery Hofsass
*Assistant Examiner*—Son Tang
(74) *Attorney, Agent, or Firm*—Squire, Sanders & Dempsey, L.L.P.

(57) ABSTRACT

The invention is directed to a system for detecting the presence or absence of a blocker to an air code flow. The system comprises an active air code generator, a sensor element through which an air code generated by the active air code generator travels, and an air code detector, which detects the air code, wherein if the detection of air code by the air code detector is interrupted, it signals the presence or absence of a blocker of the air code.

7 Claims, 2 Drawing Sheets

MOVEMENT CANCELLATION NO VIBRATION AIR CODE GENERATOR

AIR CONTROLLED SENSOR

The present application claim the benefit of priority to U.S. Provisional application No. 60/132,001, filed Apr. 30, 1999.

FIELD OF THE INVENTION

The present invention relates to a non-electric sensor.

BACKGROUND OF THE INVENTION

There are many different ways of sensing. Electronic sensors are well-known, and are used in alarm systems. In a door system, for example, the inventor considered using a typical infrared based motion detector. However, it was determined that the motion detector could not sufficiently delineate the boundaries of the detection area. So, it could not reliably or precisely located a person. Likewise, using an infrared beam was also impractical, because it could not locate where the person is.

The inventor had also tried using a mat that incorporates a mechanical switch. The mat works by forming an electronic contact between two electronic contact points as a person steps on the mat with both of his or her feet. The problem with this mechanism is that it is costly and cumbersome to install such a system, and it is not portable.

In certain automated systems there is sometimes a need for sensors that are narrow and long. Thus far, the only type of known sensor that has attempted to fulfill this need have been sensors that use thin metal sheets separated by pieces of rubber. The sensor is triggered by outside pressure whereby the thin metal sheets are contacted. This is similar to a conventional door switch, including mechanical switch and some that utilize electrical contacts.

These products are made to protect the contact surface and to protect them from metal corrosion. The outside layer is simply covered with flexible rubber. However, when the rubber is too thin, the durability is lost.

In view of the above problems, the inventor discovered a sensor, or a tread detection mechanism that does not utilize an electric contact. Applicant is unaware of any sensing system that detects flowing air code that is continuously generated from one source that is received at another end. There is a need in the art for the development of such a sensing system that provides greater flexibility, reliability and portability.

SUMMARY OF THE INVENTION

The present invention has met the herinbefore described need.

It is an object of the invention to provide a system for detecting the presence or absence of a blocker to an air code flow comprising: an active air code generator, a sensor element through which an air code generated by the active air code generator travels, and and an air code detector, which detects said air code, wherein if the detection of air code by said aid code detector is interrupted, it signals the presence or absence of a blocker of the air code.

In this system, the sensor element is a hose. The hose can be made of silicon or rubber.

In the system, the active air code generator comprises an air vibrator. The air vibrator may have two diaphragms that are aligned so that they are placed opposite each other.

Furthermore, in the system, the air code detector can be any device that can detect an air code or a frequency, and can be a condensor microphone.

In the system, the air code can be generated with alternating timed frequencies.

It is another object of the invention to provide an air pump for a fish tank, wherein the diaphragms within the pump are aligned opposite each other so that the air pump is quiet and does not manifest overt vibration.

These and other objects of the invention will be more fully understood from the following description of the invention, the referenced drawings attached hereto and the claims appended hereto.

BRIEF DESCRIPTION OF THE DRAWINGS

The present invention will become more fully understood from the detailed description given hereinbelow, and the accompanying drawings which are given by way of illustration only, and thus are not limitative of the present invention, and wherein.

DETAILED DESCRIPTION OF THE INVENTION

The sensor or tread switch works as follows. A stream of air is generated from the output end of an air vibrator containing box (aacg). The stream of air travels through a medium, preferably a hose, of any length and is detected by a sensor mechanism, preferably an air code detector, located near the input end of the same or a different box; An air code is detected and analyzed using a software, such that if someone disturbs the flow of the air code such as by stepping on the hose as the air is streamed through, and causes a disruption in the air code passing through, and the sensor senses this disruption, the software is programmed to trigger an alarm, or open a door or cause any number of other activities.

Because the system does not depend on air pressure, the product works even if the hose is torn or ripped. This feature of the sensor of the invention distinguishes it over the type of rubber hose automobile detector used in gas stations, for example. In these types of hoses, air pressure is used to pass air through the hose. As an automobile passes over the rubber hose, the air pressure is blocked, the sensor detects a block in air pressure and signals a chime. This is different from the sensor of the invention for a few reasons. Some of the advantages of using air code, and not air pressure, to detect a blockage is that the air code method allows the detection of the blockage for the duration of the blockage until the air code stream is restored, whereas the conventional air pressure method detects a momentary blockage, but cannot tell whether the blockage is continuing. Also, by relying on an air pressure method, any rip in the tube or any leakage in the tube will cause the system to malfunction. Thus, the air code system of the invention has distinct advantages over the air pressure method.

The present invention employs an active (not passive) sensing method. The central processing unit (cpu) creates a unique air code which travels through the sensor line. When this passage of the air code is blocked, the system converts to an active type sensing system.

Figure 1:
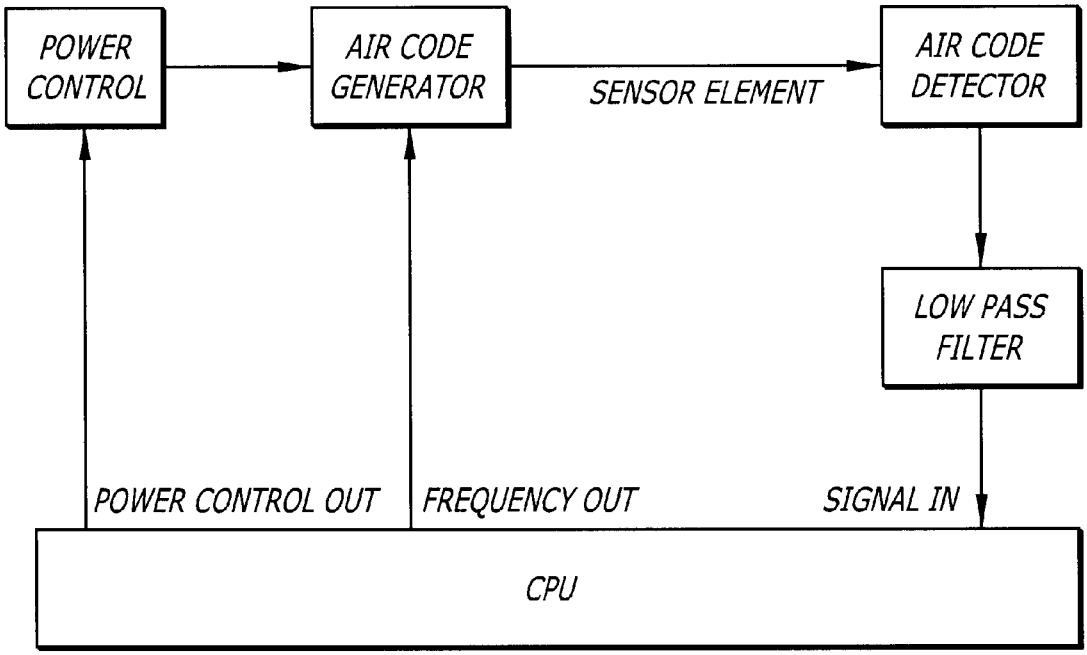
FIG. 1—shows a block diagram of the electronic circuitry surrounding the flow of air code from the active air code generator (aacg) through the sensor element to air code detector, and eventually to the central processing unit (cpu).

In FIG. 1, the active code is generated by an air vibrator that is modified so that the vibrator does not cause an outward vibration, meaning that the air vibrator does not visibly vibrate or shake. As the cpu generates a frequency, it modulates the air, and the resultant modulated air code travels through a sensor tube. The air code can be changed depending on the thickness and length of the sensor tube. The air code can be adjusted as needed to add greater complexity to the code. For example, the code can be timed so that different frequencies are promulgated at timed intervals, say, 40 hz-50 hz-40 hz, and so on. The air code detector can be a frequency sensor. For example, a cheap condenser microphone can be used, which allows for a simple amplification process, whereupon the signal passes through low pass filter, and the signal is supplied to the cpu.

Figure 2:
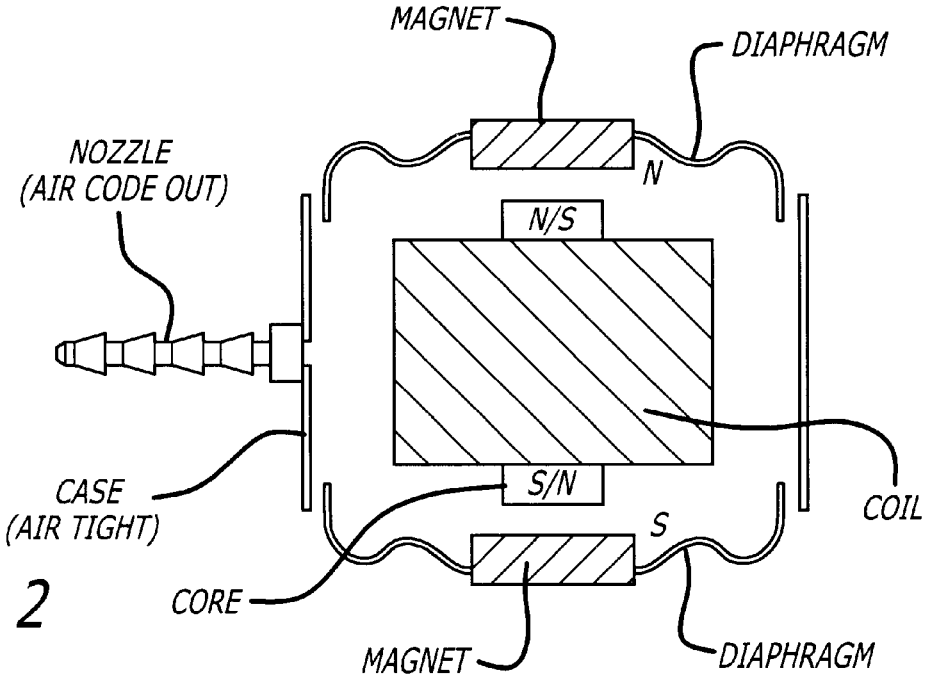
FIG. 2—shows a depiction of the active air code generator (aacg).

In FIG. 2, with regard to the aacg, it is designed in a unique way so that there is no overt vibration of the air vibrator. This is partially accomplished by aligning two diaphragms so that they face each other. When the diaphragms vibrate their vibrations cancel out. Thus, there is virtually no outward vibration visible. It is contemplated herein that such an air vibrator can be used as a very quiet air pump for use with fish tanks.

To describe aacg in further detail, two diaphragms and associated magnets face each other. In order to cancel out the mechanical vibrations, the polarity of the magnets is the key point. The magnets must face each other of opposite polarity. For example, in FIG. 2, if the upper magnet facing the core is S, then the lower magnet facing the core is N. Thus, as the upper diaphragm is moving away from the core, the lower diaphragm is simultaneously moving away from its core as well. In the same way, as the upper diaphragm moves closer to its core, the lower diaphragm moves closer to its core as well. This results in air modulation that is increased by two-fold. At the same time, an additional advantage gained from this design is that this also results in a mechanical cancellation of vibration, which results in a quiet vibration-free feel to the air code generator.

Figure 3:
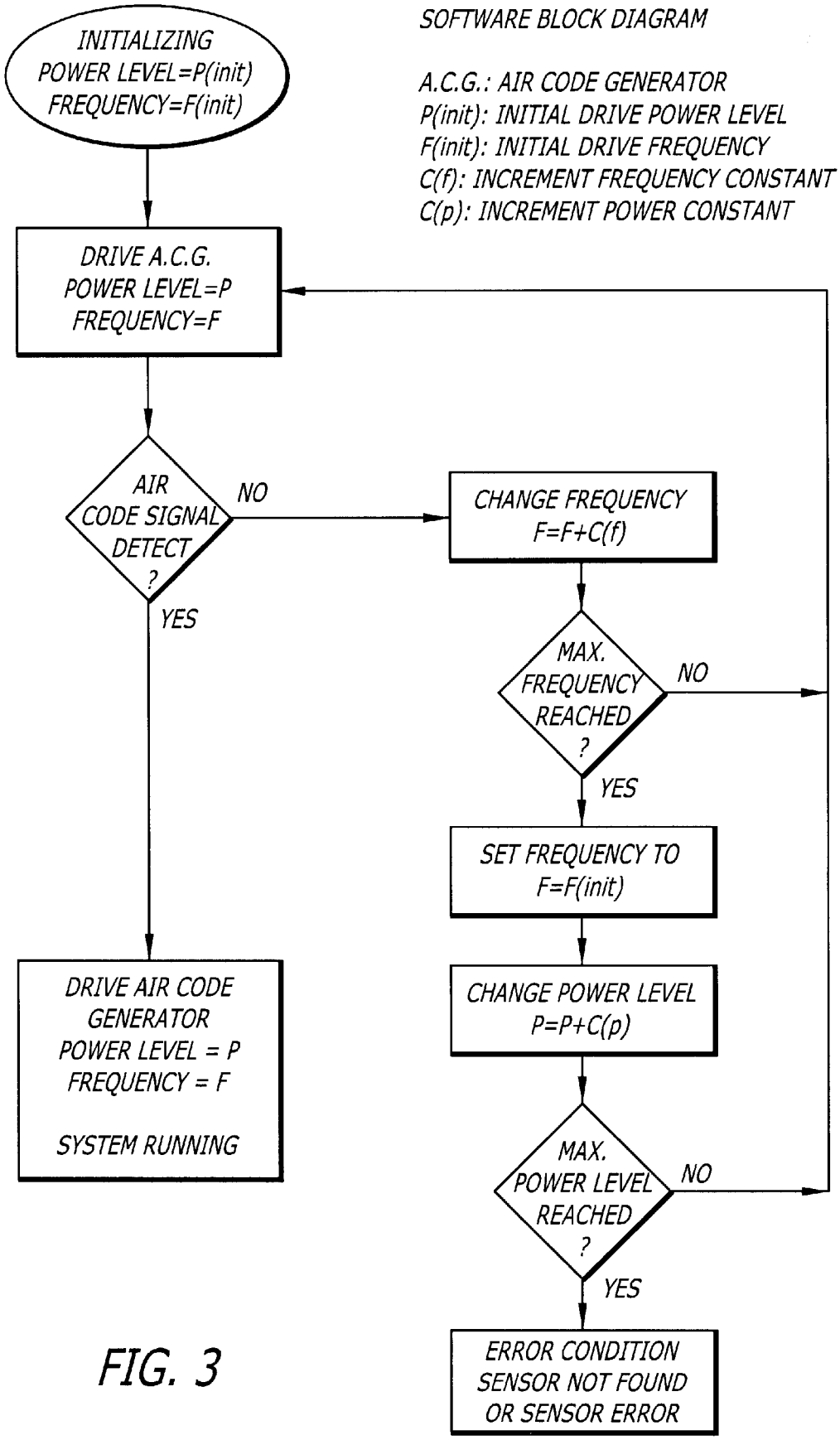
FIG. 3—shows a software block diagram.

In FIG. 3, a software flowchart is shown that is used with the system of the invention.

These are some of the special features of the Tread Switch.

1. Depending on the internal diameter (I.D.) and length of the tube, the air pressure and air code can be set so that air vibrator can provide sufficiently strong air pressure through the tube.
2. As the parameters are set, an LED light can be made to blink. When the parameters have been set, the LED light turns off. The Tread Switch is now activated.
3. When the tube is pressed at any point, and the software detects that the air code is missing, or disrupted, then the LED light goes on.

Special Advantageous Features

1) Effective. A loop is formed without any electronic contact point. An ⅛" I.D., 100 ft. long tube, used as a sensor tube worked very well. Even when a rip was introduced into the tube, the sensor functioned without any interruption.
2) Safe. This product can be used in any condition, even when the creation of an electric spark is a concern, such as under water.
3) Durable. Any pressure brought to bear on the system is felt only on the tube. The body of the system is not affected. A tube can be easily replaced.
4) Cost effective. The product is cost effective. The product costs less than $30.00 to make for the aluminum extrusion case, and ⅛" I.D. 100' silicon tube.
5) Flexible. The shape of the sensor can be changed as desired depending on how one desires the hose to be configured or layed out, such as for example, in a zig-zag layout when a large area of detection is desired to be covered. The level of detection desired can be optionally changed by merely changing the tube. A very thin 1/32" to above 1 inch I.D. having any length at all, including a length of at least 50' can be used. It should be known that the diameter or length should not be limited, as it is limited only by the limitations of the source of the air code, and if more power is needed, then a repeater can be installed to provide greater propulsion. If the tube is made thicker, an even longer tube can be used.
   i) An optional repeater can be used so that even very long tubes can be incorporated into the system.
   ii) Double tubes can be used, or even create a web of tubes.
   iii) The output device and input device can be on one or separate containers.
6) Reliable. Since the basis of the air code is not related to air pressure, even though the tube may be ripped or torn, it does not affect the effectiveness of the product. The tube may be made of silicon or any other rubber or non-rubber product so long as the enclosure allows air code to travel through it.

The following examples are offered by way of illustration of the present invention, and not by way of limitation.

EXAMPLE

A ⅛" i.d., 100 ft. tube using not more than 1W (power consumption—12V, 0.7 A) was used in the sensor described above, and resulted in detection of blockage at various sites on the sensor tube.

The invention being thus described, it will be obvious that the same may be varied in many ways. Such variations are not to be regarded as a departure from the spirit and scope of the invention, and all such modifications as would be obvious to one of ordinary skill in the art are intended to be included within the scope of the following claims.

What is claimed is:

1. A system for detecting the presence or absence of a blocker to an air code flow comprising: an active air code generator, a sensor element through which an air code generated by the active air code generator travels, and and an air code detector, which detects said air code, wherein if the detection of air code by said aid code detector is interrupted, it signals the presence or absence of a blocker of the air code.

2. The system according to claim 1, wherein said sensor element is a hose.

3. The system according to claim 2, wherein said hose is silicon hose or a rubber hose.

4. The system according to claim 1, wherein said active air code generator comprises an air vibrator.

5. The system according to claim 4, wherein said air vibrator has two diaphragms that are aligned so that they are opposite each other.

6. The system according to claim 1, wherein said air code detector is a condenser microphone.

7. The system according to claim 1, wherein said aid code is generated with alternating timed frequencies.

* * * * *